United States Patent [19]

Bixby

[11] Patent Number: 4,512,440

[45] Date of Patent: Apr. 23, 1985

[54] RUNGLESS MOTORIZED LADDER

[76] Inventor: Lawrence B. Bixby, Rte. 2, Box 1671, Oklawaha, Fla. 32679

[21] Appl. No.: 560,562

[22] Filed: Dec. 12, 1983

[51] Int. Cl.[3] ..... E06C 1/00; A63B 27/04

[52] U.S. Cl. ..... 182/146; 182/134; 182/148; 187/11

[58] Field of Search ..... 182/145, 146, 194, 141, 182/133, 134, 148, 142; 187/11

[56] References Cited

U.S. PATENT DOCUMENTS

| | | | |
|---|---|---|---|
| 213,715 | 3/1879 | Von Mengden . | |
| 810,254 | 1/1906 | Borneman . | |
| 1,307,468 | 6/1919 | Wells . | |
| 2,311,352 | 2/1943 | Seiler . | |
| 2,562,634 | 7/1951 | Nelson | 187/11 |
| 2,936,848 | 5/1960 | Hall | 182/2 |
| 3,075,611 | 1/1963 | Baringer | 182/134 |
| 3,078,951 | 2/1963 | Schneebeli et al. . | |
| 3,115,211 | 12/1963 | Ostrander | 187/11 |
| 3,126,071 | 3/1964 | Basset . | |
| 3,385,401 | 5/1968 | Campbell | 187/11 |
| 3,470,980 | 10/1969 | Irwin | 182/2 |
| 3,520,383 | 7/1970 | Loock . | |
| 3,968,858 | 7/1976 | Vollan et al. . | |
| 4,008,785 | 2/1977 | Mugnaini . | |
| 4,060,149 | 11/1977 | Henley . | |
| 4,301,891 | 11/1981 | Harbian . | |
| 4,310,070 | 1/1982 | Mastrogiannis | 182/134 |

*Primary Examiner*—Reinaldo P. Machado
*Attorney, Agent, or Firm*—Henderson & Sturm

[57] ABSTRACT

A rungless motorized ladder of a type having an elongated pole with a cable attached at the top thereof. At the bottom thereof, the cable is attached to a spool which is motorized. The spool is attached to a carriage having a place for receiving a person's feet. Foot controls are provided on such carriage for permitting persons utilizing the device to move the carriage up or down on the pole with a simple movement of one foot. Likewise, when the foot control is not being utilized, an automatic braking device is provided for holding the carriage securely in a stationary position.

7 Claims, 8 Drawing Figures

RUNGLESS MOTORIZED LADDER

TECHNICAL FIELD

The present invention relates generally to a motorized rungless ladder, and more particularly to such a ladder which is winch operated.

BACKGROUND ART

It has long been recognized that ladders of the conventional type having rungs thereon are inconvenient and somewhat difficult to use. Consequently, there have been many devices designed to improve on such conventional structure. For example, U.S. Pat. Nos. 3,968,858 to Vollan and 4,301,891 to Harbian show attempts to use mechanical devices for climbing which are powered by the person utilizing the climbing devices.

Similarly, various devices have been devised for using motors to move a carriage and a person up or down a pole. For example, see U.S. Pat. Nos. 3,520,383 to Loock; 4,008,785 to Mugnaini; and 4,060,149 to Henley. A major problem with the prior art is that it is extremely complicated to use and expensive to construct. Accordingly, there still exists a need for a motorized rungless ladder which overcomes these basic deficiencies in the prior art.

DISCLOSURE OF THE INVENTION

The present invention relates to a rungless motorized ladder of a type having an elongated pole with a cable attached at the top thereof and then at the bottom thereof is attached to a spool which is motorized and is attached to a carriage having a place for receiving a person's feet. Foot controls are provided on such carriage for permitting persons utilizing the device to move the carriage up or down on the pole with a simple movement of one foot. Likewise, when the foot control is not being utilized, an automatic braking device is provided for holding the carriage securely in a stationary position.

An object of the present invention is to provide an improved rungless motorized ladder.

Another object of the present invention is to provide a device of a type aforementioned which is economical to produce and dependable to use.

Other objects, advantages and novel features of the present invention will become apparent from the following detailed description of the invention when considered in conjunction with the accompanying drawings.

BEST MODE FOR CARRYING OUT THE INVENTION

Figure 1:
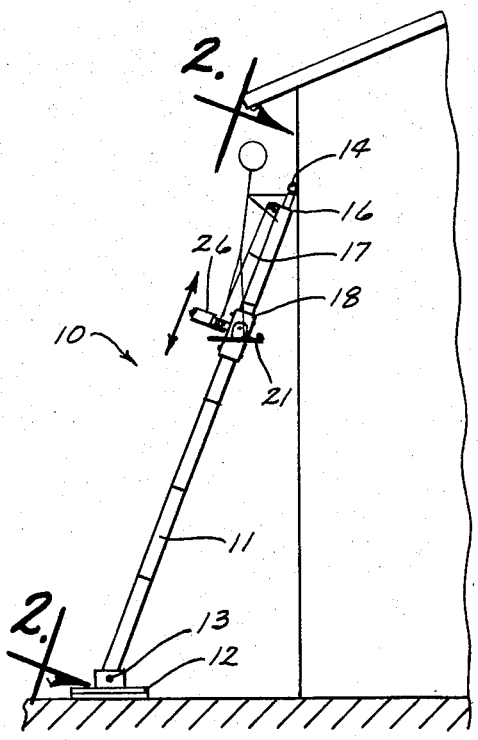
FIG. 1 shows a side elevational view of the present invention in use.

Referring now to the drawings wherein like reference numerals designate identical or corresponding parts throughout the several views, FIG. 1 shows the invention (10) in use. The rungless motorized ladder apparatus (10) of the present invention includes a pole (11) having a plurality of sections which telescope together at the ends of each section. Any number of these sections may be added, or taken away, from the pole (11) depending upon the desired length of such device for the application for which it is to be used. A base (12) is provided at the bottom of such rungless ladder (10) and the pole (11) is pivotally attached to the base (12) by means of a pin (13). The top of the rungless ladder has a pair of resilient or rubberized pads (14) extending from metal rods (15), which metal rods (15) are rigidly attached to the topmost section of the pole (11). A cable clamp structure (16) is provided for clamping a cable (17) thereto for reasons which will be apparent below.

Figure 2:
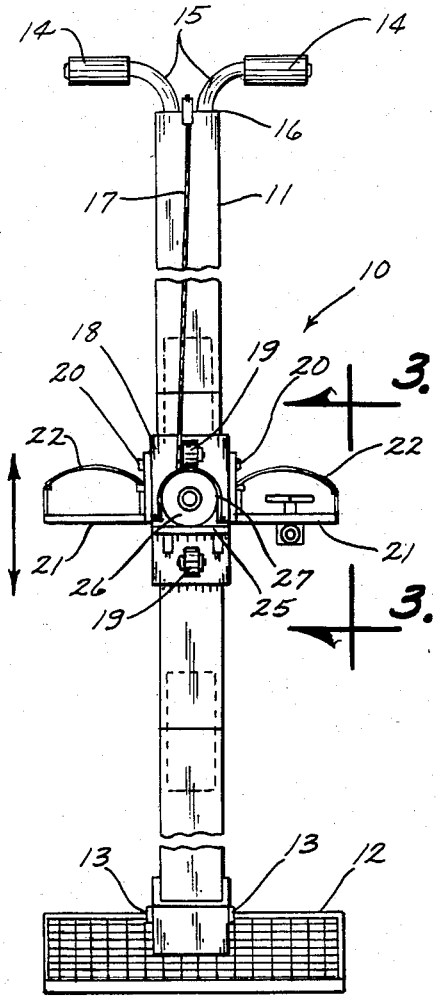
FIG. 2 is a view of the present invention taken along line 2—2 of FIG. 1.
Figure 3:
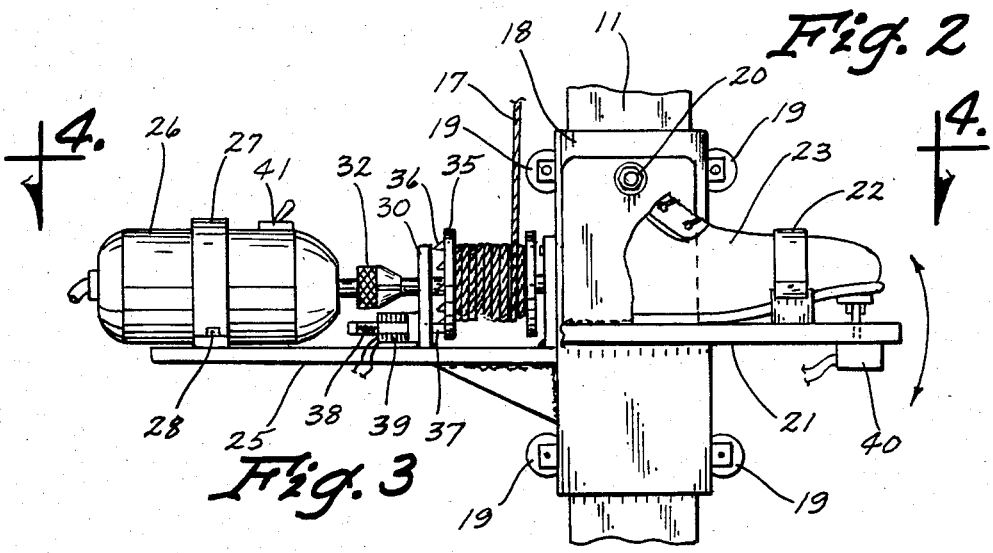
FIG. 3 is an enlarged sectional view of the present invention taken along line 3—3 of FIG. 2.

Referring to FIGS. 2 and 3, it is noted that a carriage (18) extends around the pole (11) and this carriage (18) has a plurality of rollers (19) attached thereto for preventing binding of the carriage (18) as it moves up and down pole (11) and for also eliminating the need for lubricating the pole (11) to prevent friction between the pole (11) and the carriage (18).

Pivotally attached on carriage (18) at bolt (20) are a pair of foot receiving structures (21). These foot receiving structures (21) include a platform and a hold-down strap (22) for securely holding a foot (23) in place. This can readily be seen in FIG. 3.

Figure 7:
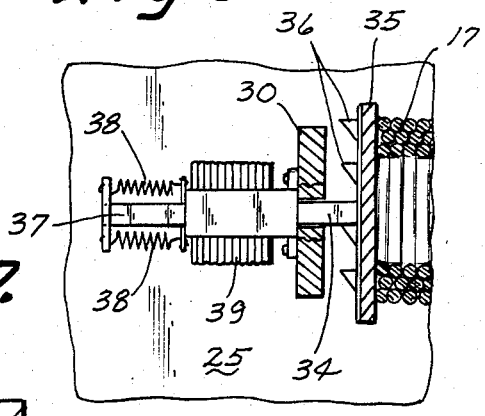
FIG. 7 is a cross-sectional view taken along line 7—7 of FIG. 6.

Also attached to carriage (18) is a platform (25) for securely mounting a motor (26) thereto by means of a strap (27) and fasteners (28). A spool (29) is pivotally attached to platform (25) by means of upstanding members (30) and (31). Rotation of the spool (29) is effected by means of rotation of the motor (26) which is connected to the spool (29) by means of a chuck structure (32). A ratchet (35) is provided on one side of the spool (29) and has a plurality of teeth (36) extending therefrom. An armature member (37) is biased into contact with the ratchet plate (35) as can be seen in FIGS. 3 and 7, and when this armature member (37) is so biased against the plate (35) by means of springs (38), the spool (29) is prevented from moving and allowing the weight of the carriage (18) and the person standing thereon to move downwardly. It is noted that the flat side of the tooth (36) will contact the armature (37), for example in the position shown in FIG. 7, to prevent such movement.

Figure 4:
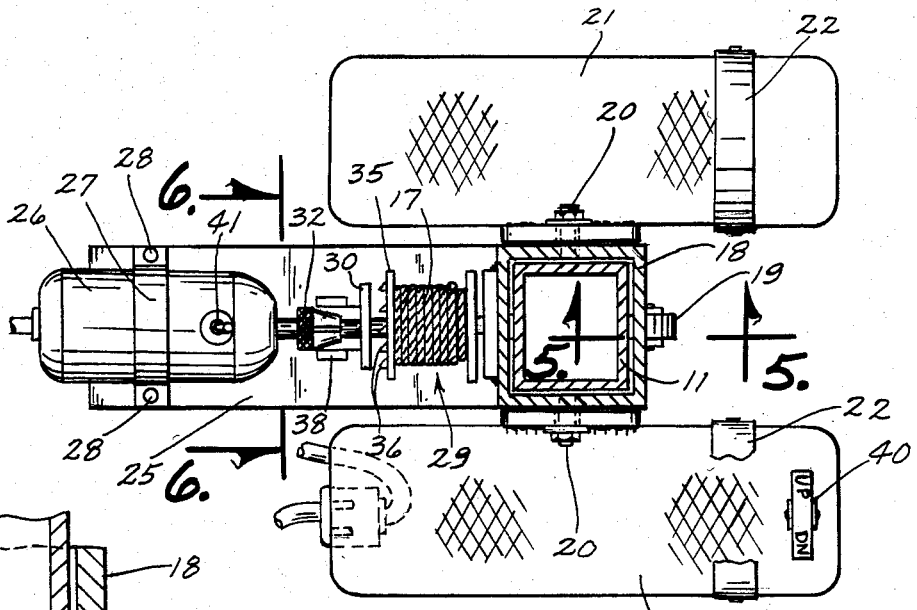
FIG. 4 is a cross-sectional view taken along line 4—4 of FIG. 3.
Figure 5:
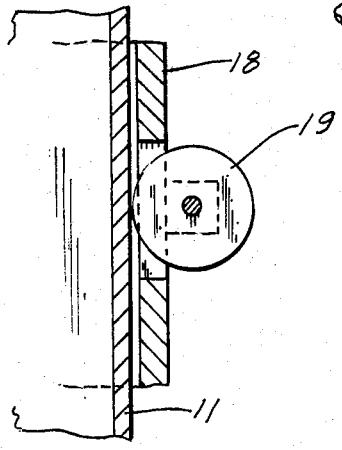
FIG. 5 is an enlarged cross-sectional view taken along line 5—5 of FIG. 4.
Figure 8:
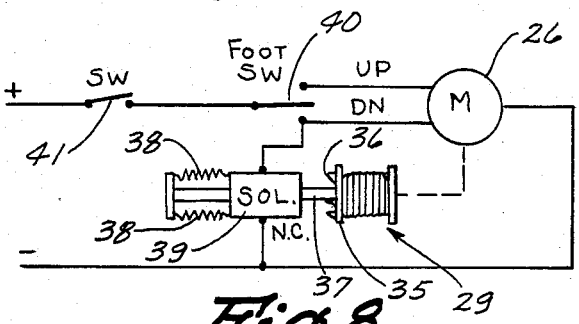
FIG. 8 is a schematic view of the electrical circuit of the present invention.
Figure 6:
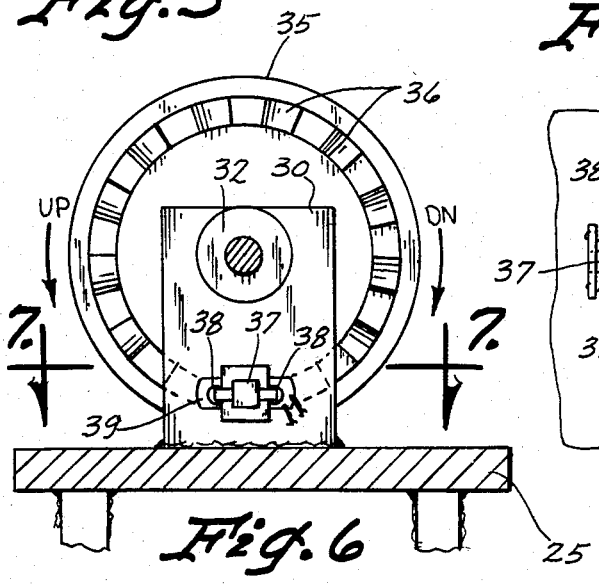
FIG. 6 is a cross-sectional view taken along line 6—6 of FIG. 4.

It is also noted that in FIGS. 2 and 3 a foot pedal switch (40) is mounted on the right-most one of the foot platforms (21), although it will be readily understood that it could be located elsewhere. This foot pedal switch is biased to a neutral position shown in FIGS. 2, 3 and 8. However, when it is desired to go up on the rungless ladder, the foot pedal is depressed on the left side of such pedal, for example as shown in FIG. 4, and this will cause the motor (26) to rotate in a direction to wind-up the cable (17) onto the spool (29) and at the same time will cause the solenoid (39) to be activated to allow such rotation. It will be understood of course that the master switch (41) must be on initially for this apparatus to be operable.

When it is desired to go down the rungless ladder, then the right side of the right foot would be pushed down so that the switch (40) would turn the motor (26) in an opposite direction to cause the motor (26) to unwind the cable (17) which is wound on the spool (29); and, at the same instance, will activate the solenoid (39) to cause the armature (37) to move out of the way of the ratchet teeth (36).

It is also to be noted that, if it is desired to use the present invention to go straight up and down, rather than to lean it up against a building or the like, then rotation along the pin (13) could be prevented, for example by utilizing a second pin as well, and broadening the base (12). Of course, the platform (21) pivots about bolt (20) and remains horizontal regardless of the orientation of pole (11). Obviously, many other modifications and variations of the present invention are possible in light of the above teachings. It is therefore to be understood that, within the scope of the appended claims, the invention may be practiced otherwise than as specifically described.

I claim:

1. A rungless motorized ladder apparatus comprising:
an elongated pole;
a carriage means disposed on said pole for movement up or down along said pole;
foot receiving means attached to said carriage means for permitting a person to stand thereon and move up or down with the movement of said carriage means;
a winch means operably attached to said carriage means, said winch means including a spool having a cable attached thereto at one end thereof for permitting such cable to be wound thereon;
means for attaching the other end of said cable to the top of said pole;
electric motorized means on said carriage means for rotating said spool for selectively pulling said carriage up or permitting said carriage to move downwardly; and
foot pedal switch means attached to said foot receiving means for causing said spool to turn in one rotary direction when one side of said foot pedal switch means is pushed or to turn said spool in the other rotary direction when the other side of said switch means is pushed.

2. The apparatus of claim 1 including:
means on the top of said pole for abutment with the side of a building or the like; and
means on the bottom of said pole for abutment with the ground or the like.

3. The apparatus of claim 1 wherein said foot pedal switch means is biased to a neutral position for turning off the motorized means completely when the switch means is not depressed.

4. A rungless motorized ladder apparatus comprising:
an elongated pole;
a carriage means disposed on said pole for movement up or down along said pole;
foot receiving means attached to said carriage means for permitting a person to stand thereon and move up or down with the movement of said carriage means;
a winch means operably attached to said carriage means, said winch means including a spool having a cable attached thereto at one end thereof for permitting such cable to be wound thereon;
means for attaching the other end of said cable to the top of said pole;
electric motorized means on said carriage means for rotating said spool for selectively pulling said carriage up or permitting said carriage to move downwardly;
foot pedal switch means is attached to said foot receiving means for causing said spool to turn in one rotary direction when one side of said foot pedal switch means is pushed or to turn said spool in the other rotary direction when the other side of said switch means is pushed, said foot pedal switch means being biased to a neutral position for turning off the motorized means completely when the foot pedal switch means is not depressed;
a ratchet attached to said spool;
solenoid means having an armature biased into contact with said ratchet for holding said ratchet and spool from rotation when said solenoid is deactivated; and
solenoid switch means for activating said solenoid means when said motor is turned on by said foot pedal switch for causing said armature to be pulled away from said ratchet means, whereby said spool will be free to rotate when said motorized means is on and said spool will be prevented from rotating when said motorized means is off.

5. The apparatus of claim 4 including:
means on the top of said pole for abutment with the side of a building or the like; and
means on the bottom of said pole for abutment with the ground or the like.

6. A rungless motorized ladder apparatus comprising:
an elongated pole;
a carriage means disposed on said pole for movement up or down along said pole;
foot receiving means attached to said carriage means for permitting a person to stand thereon and move up or down with the movement of said carriage means;
a winch means operably attached to said carriage means, said winch means including a spool having a cable attached thereto at one end thereof for permitting such cable to be wound thereon;
means for attaching the other end of said cable to the top of said pole;
electric motorized means on said carriage means for rotating said spool for selectively pulling said carriage up or permitting said carriage to move downwardly; and
means for pivotally attaching said foot receiving means to said carriage means whereby said foot receiving means will have a horizontally disposed surface thereon for receiving a person's foot regardless of the orientation of said pole.

7. The apparatus of claim 6 including:
means on the top of said pole for abutment with the side of a building or the like; and
means on the bottom of said pole for abutment with the ground or the like.

* * * * *